United States Patent [19]

Zuviria

[11] Patent Number: 5,069,647

[45] Date of Patent: Dec. 3, 1991

[54] SOLID RECTANGULAR BUILDING BLOCK FOR A TOY BUILDING SET

[76] Inventor: Marcelo M. Zuviria, 2319 14th Street, Apt. 7, Santa Monica, Calif. 90405

[21] Appl. No.: 511,342

[22] Filed: Apr. 19, 1990

[51] Int. Cl.[5] ..... A63H 33/08

[52] U.S. Cl. ..... 446/127; 446/95; 446/120; 52/594

[58] Field of Search ..... 446/127, 124, 128, 125, 446/93, 94, 95, 120, 121; 52/593, 594, 591, 590, 589

[56] References Cited

U.S. PATENT DOCUMENTS 3,554,236 1/1971 Rhodes ..... 446/124 X 4,035,947 7/1977 Burge ..... 446/127

4,676,762 6/1987 Ballard ..... 446/124 X

FOREIGN PATENT DOCUMENTS 464185 3/1914 France ..... 446/127

*Primary Examiner*—Mickey Yu

[57] ABSTRACT

A solid rectangular building block for a toy building set which is intended to interlock frictionally with like building blocks. The building block has a plurality of intersecting grooves formed in its faces in a predetermined patterned, and it also has a number of tongues extending outwardly from certain other faces which are intersected by the grooves and which are intended to fit into the grooves of like blocks in a frictional relationship with the grooves.

10 Claims, 7 Drawing Sheets

FIG. 7A
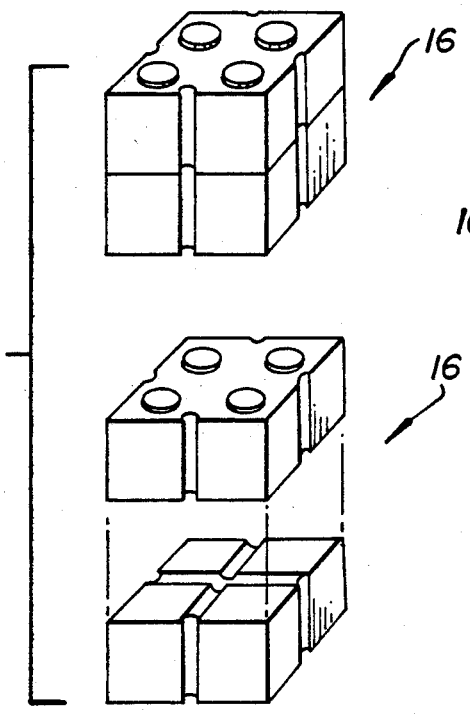
FIG. 7B
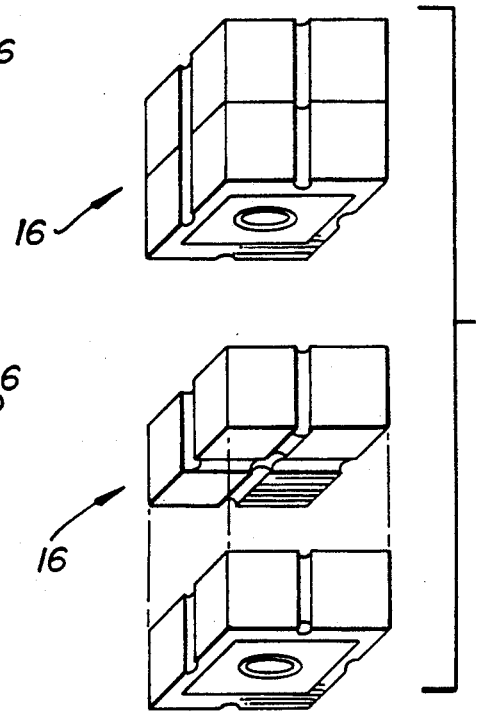
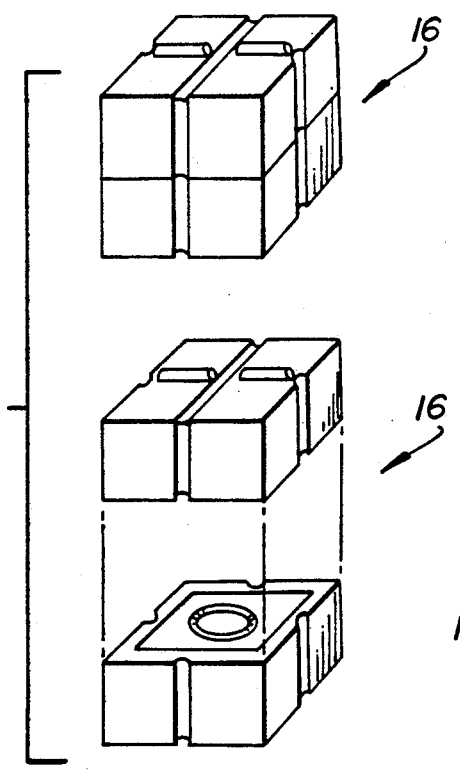
FIG. 8A
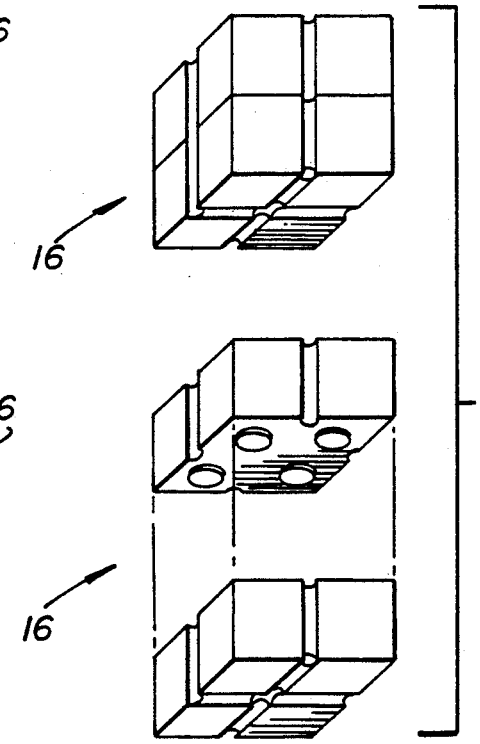
FIG. 8B

SOLID RECTANGULAR BUILDING BLOCK FOR A TOY BUILDING SET

BACKGROUND OF THE INVENTION

Toy building sets which basically comprise a number of interlocking building blocks have been available on the market for many years, and which are sold throughout the world under the trademark "LEGO". The LEGO building blocks have a distinctive configuration, in that one or more of the surfaces of each block are formed with a multiplicity of individual protuberances, and one or more of the surfaces of each block are also formed with one or more hollow bosses. With such a configuration, the LEGO building blocks may be interlocked with one another in a releasable manner, so that a variety of buildings, vehicles, or other structures may be formed.

An objective of the present invention is to provide building blocks for a toy building set of the same general type as the "LEGO" blocks, but which are constructed to enable a wide range of structures to be assembled easily and conveniently.

A feature of the invention is the provision of solid rectangular building blocks for toy building sets, the blocks being configured to provide tongues and grooves in the mating surfaces of the building blocks to enhance the utility of the building blocks, and for the construction of a wide variety of articles of different sizes and shapes.

SUMMARY OF THE INVENTION

The invention provides solid rectangular building blocks for toy building sets which are intended to interlock with like building blocks. The solid rectangular building block of the invention each has a plurality of intersecting grooves formed on its faces of a predetermined pattern, and a of tongues extending outwardly from certain of its faces to fit into the groves of like blocks in an interlocking relationship therewith.

A BRIEF DESCRIPTION OF THE DRAWINGS

FIGS. 1A, 1B; 2A, 2B; 3A, 3B; 4A, 4B; 5A, and 5B; are perspective representations of different types of building blocks embodying the teachings of the invention;

FIG. 6 is a perspective view of one of the building blocks of the invention included in an area a wheel sub-assembly for a vehicle;

FIGS. 7A, 7B; 8A and 8B are various perspective views of split blocks of the present invention.

DETAILED DESCRIPTION OF THE ILLUSTRATED EMBODIMENTS

Figure 1A:
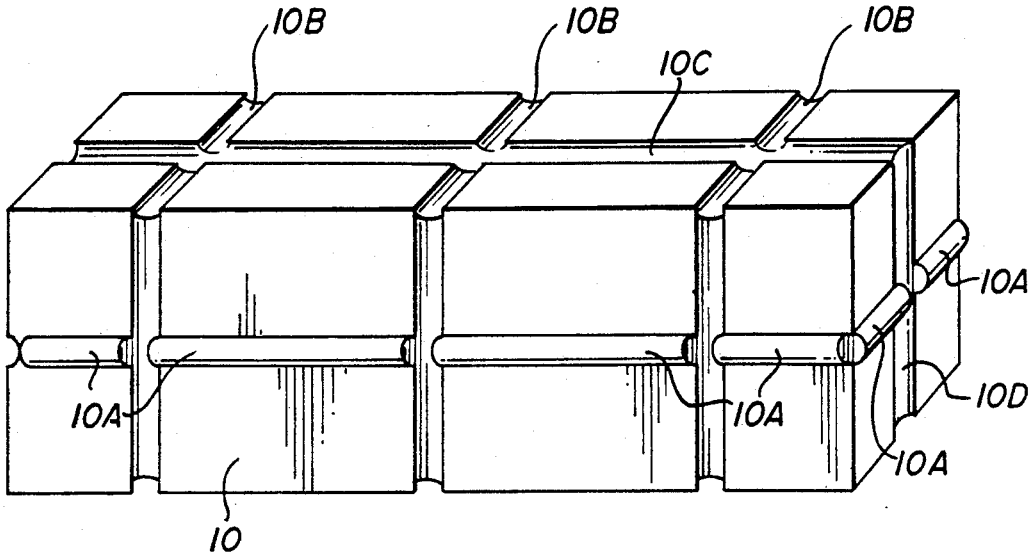
Figure 1B:
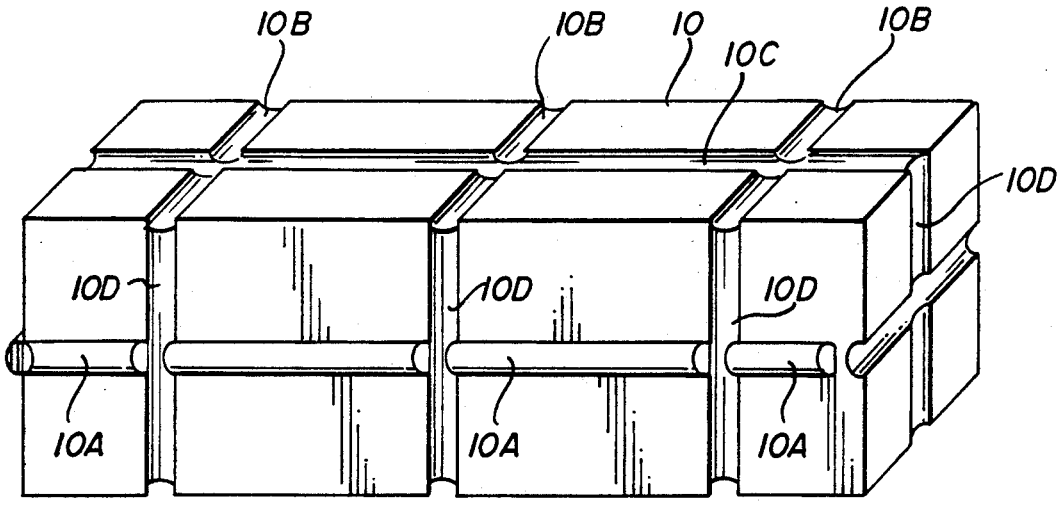

As shown in FIGS. 1A, and 1B one of the building blocks of the invention, designated 10, is a solid rectangular block having six faces, with an intermediate integral planar member forming a number of accurate shaped tongues 10A lying in a plane parallel to a first two (2) of the faces and projecting beyond the planes of three (3) of the remaining faces. The first two (2) faces of the block 10 have three parallel accurate transverse grooves 10B formed in them, which are intersected by a longitudinal groove 10C. The other faces, as shown, have transverse grooves 10D which, in some instances, actually intersect the projecting tongues of the planar member.

A tongue 10A projects from one end of the block 10 (FIG. 1A) and is intersected by a transverse groove 10D. The other end of the block is planar, and it has intersecting transverse grooves 10D formed in it (FIG. 1B).

Figure 2A:
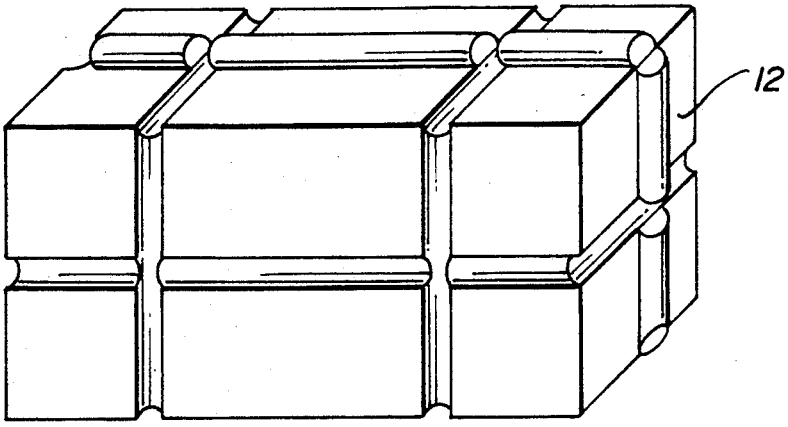
Figure 2B:
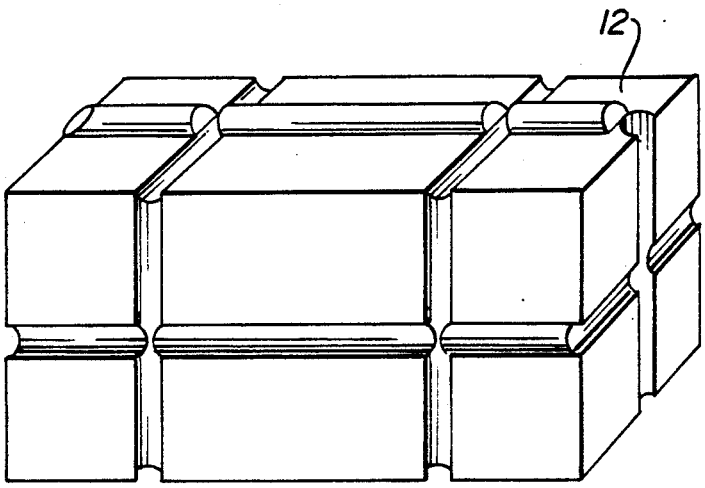

The building block 12 of FIGS. 2A and 2B is similar to the block 10 of FIGS. 1A and 1B, except that it is somewhat smaller, and has two (2) parallel transverse grooves in each of two sides. Otherwise, the construction of block 12 is similar to block 10.

Figure 3:
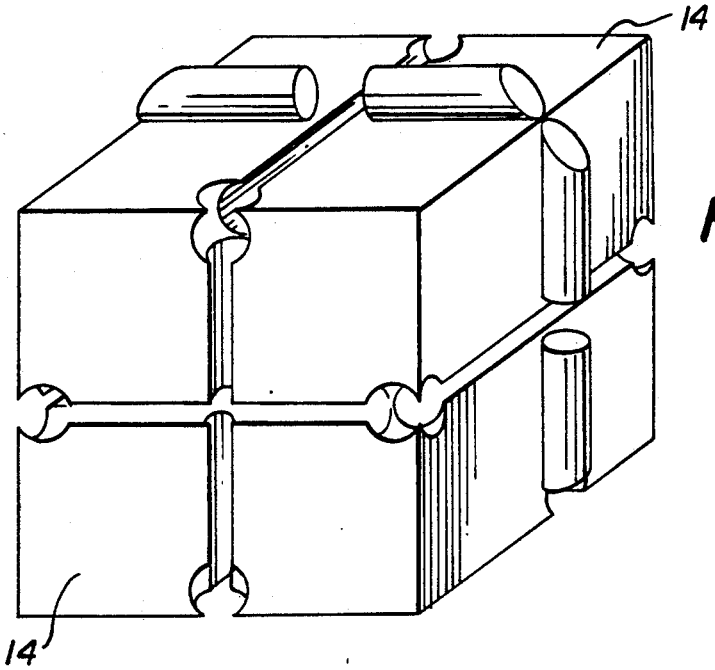
Figure 4A:
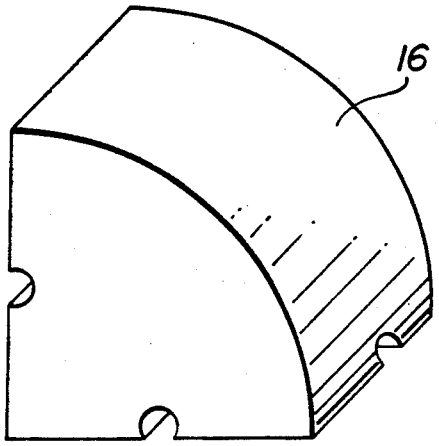
Figure 4B:
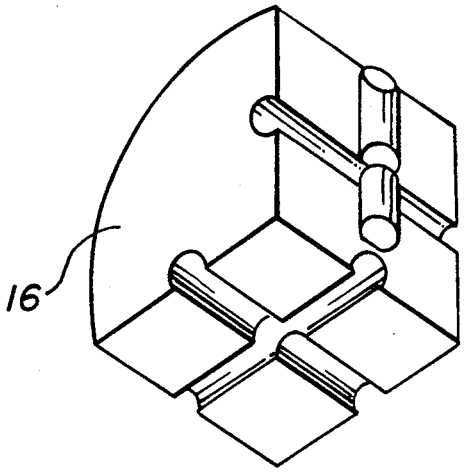
Figure 5A:
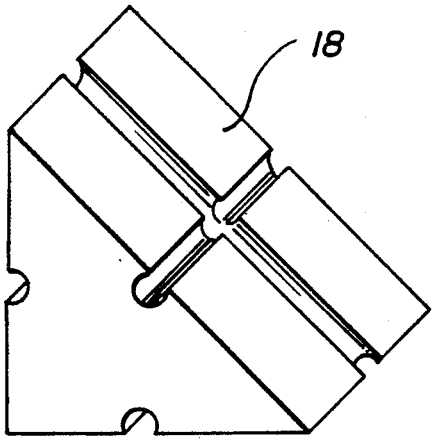
Figure 5B:
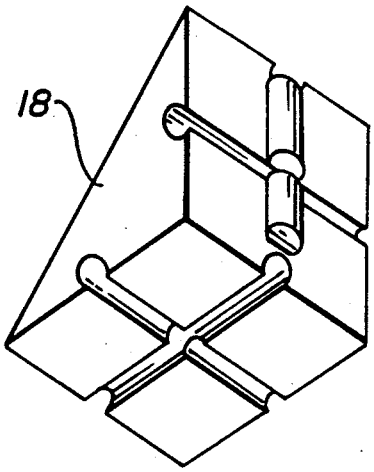

Likewise, block 14 of FIG. 3 is smaller than block 12, and it has but a single transverse groove in two (2) of its sides. Block 16 of FIGS. 4A and 4B has a curved configuration, and finds utility in the construction of various articles. This also applies to the triangular blocks 18 of FIGS. 5A and 5B.

In each case, the blocks of FIGS. 1A, 1B; 2A, 2B; 3A, 3B; 4A, 4B; 5A and 5B may be interlocked together by sliding the tongues into corresponding grooves or by snapping the tongues into the grooves.

Figure 6:
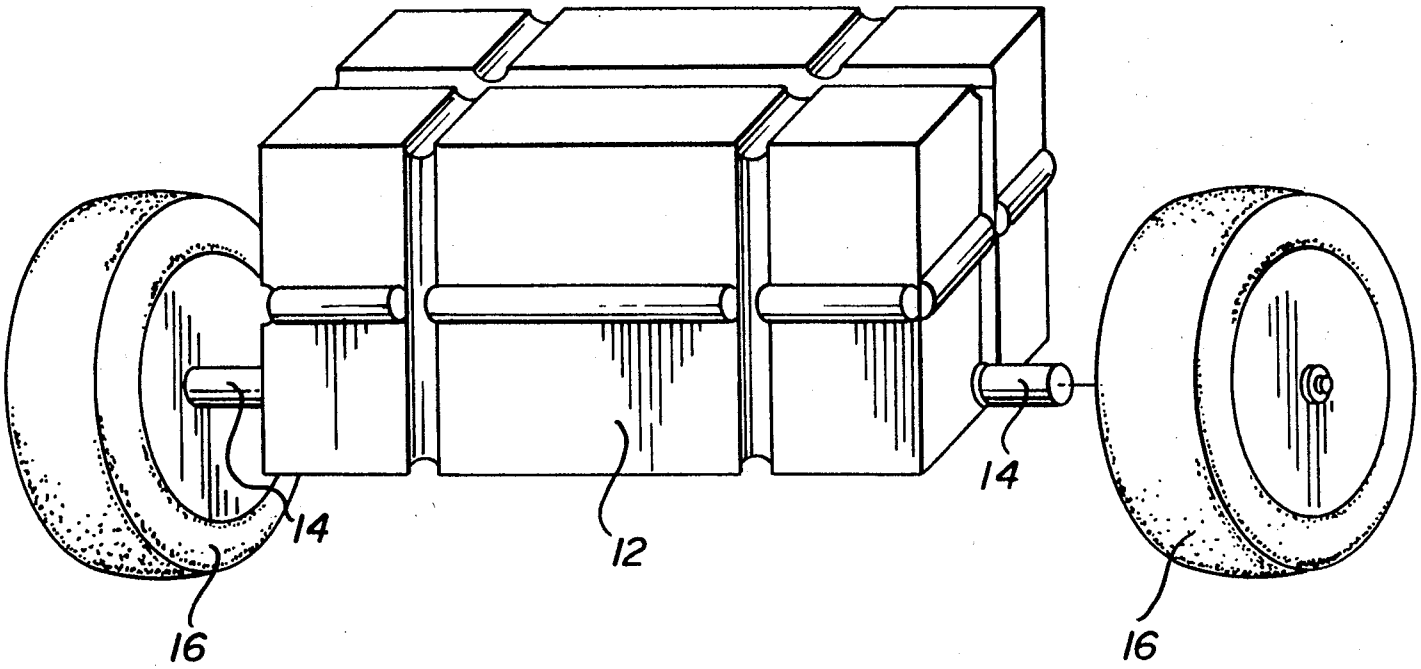

FIG. 6 shows the block 12 of FIGS. 2A and 2B with a hole extending through the block to receive an axle 15. Wheels 17 may be mounted on the axle to form a sub-assembly for a vehicle.

FIGS. 7A, 7B; 8A and 8B are various perspective views of a split block 16 which is adapted to be used in conjunction with conventional type "LEGO" Blocks.

Figure 9:
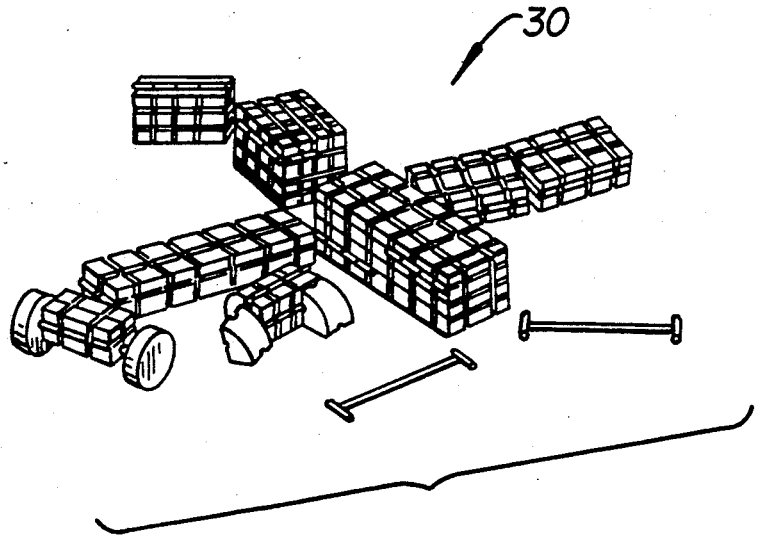
FIG. 9 shows the blocks partially assembled in a configuration ultimately to represent and an aircraft.
Figure 10:
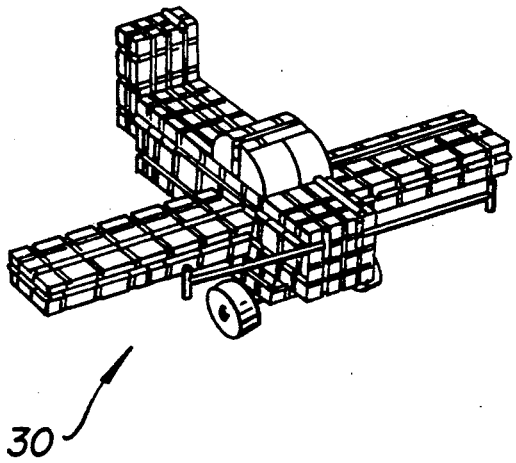
FIG. 10 shows the assembled aircraft from the blocks.

As mentioned above, FIG. 9 shows a group of building blocks of the type described above partially assembled to constitute an aircraft 30, such as shown in FIG. 10.

Figure 11:
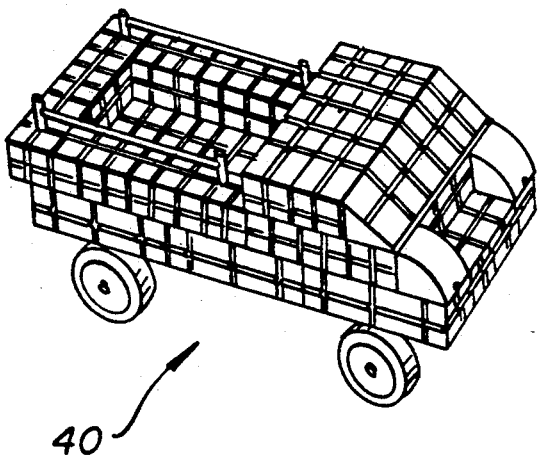
FIG. 11 is a perspective showing of the blocks formed as a truck.
Figure 12:
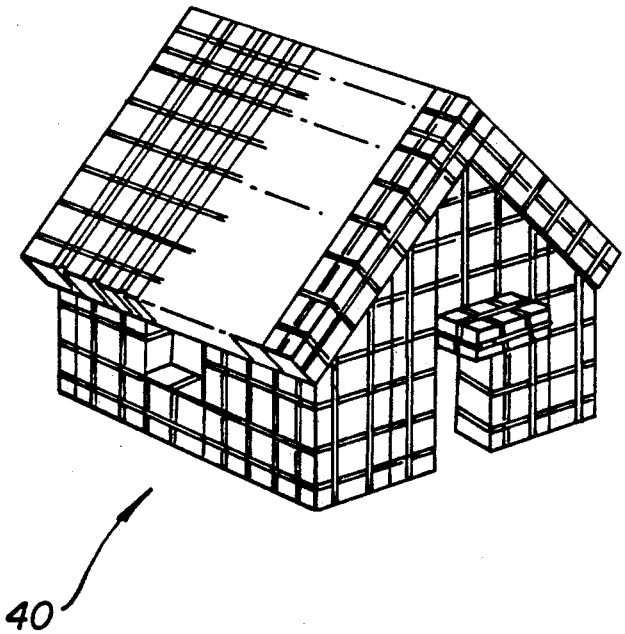
FIG. 12 shows the blocks formed as a building.

FIG. 11 shows a group of blocks, such as described above assembled to constitute a truck 40. FIG. 12, on the other hand, shows a number of the blocks assembled to constitute a building 50.

It will be appreciated that a wide variety of trucks, aircraft, buildings and other structures may be formed easily and conveniently by using the particular building blocks described above.

It will be appreciated that while a particular embodiment of the invention have been shown and described, modifications may be made. It is intended in the claims to cover all modifications which come within the true spirit and scope of the invention.

I claim:

1. A solid rectangular building block or a toy building set, said block having size faces and an integral intermediate planar member lying in a plane parallel to a first two of aid faces and projecting beyond the plane of at least one of the remaining faces to constitute a tongue, said fist two of said faces each having at least two intersecting grooves therein extending perpendicular to one another for receiving the tongue of a like building block in frictional interlocking relationship therewith; and in which said one of aid remaining faces has at least one intermediate groove therein perpendicular to the plane of said planar member and intersecting said tongue.

2. The solid rectangular building block defined in claim 1, in which said planar member projects beyond the plane of at least two of the remaining faces to constitute tongues, and said two of said remaining aces each having at least one groove therein perpendicular to the plane of said planar member nd intersecting corresponding ones of said tongues.

3. The solid rectangular build block defined in claim 1, in which said planar member protrudes beyond the plane of at least three of the remaining faces of said block to constitute tongues, and said three of said remaining faces each has at least one groove therein perpendicular to the plane of said planar member and intersecting corresponding ones of said tongues.

4. The solid rectangular building block defined in claim 3, in which a further remaining face of the block has an intermediate groove therein perpendicular to the plane of said planar member.

5. A solid rectangular building block for a toy building set, said block having six faces and an integral intermediate planar member lying in a plane parallel to a first two of said faces and projecting beyond the plane of at least one of said remaining faces to constitute a tongue, said first two of aid faces each having at least two parallel transverse grooves therein and a longitudinal groove therein extending perpendicular to said transverse grooves and intersecting said transverse grooves, said grooves being dimensioned to receive a tongue f a like building block in frictional interlocking relationship therewith; and in which said one of said remaining faces has an intermediate groove therein perpendicular of the plane of said planar member and intersecting said first named tongue.

6. The solid rectangular building block defined in claim 5, in which the planar member protrudes beyond the plane of at least two of said remaining faces to constitute tongues, and said two of said remaining faces each has a groove therein perpendicular to ht plane of said planar member and intersecting corresponding ones of said tongues.

7. The solid rectangular building block defined in claim 5, in which said first two of said faces each has three parallel transverse grooves therein and a longitudinal groove therein extending perpendicular to said transverse grooves and intersecting said transverse grooves, said grooves being dimensioned to receive the tongue of a like building block in frictional interlocking relationship therewith.

8. The solid rectangular building block defined in claim 5, in which said planar member protrudes beyond the planes of three of said remaining faces to constitute tongues, said three of said remaining faces each has a groove therein perpendicular o the plane of said planar member and intersecting corresponding ones of said tongues.

9. The solid rectangular building block defined in claim 8, in which a further remaining face of said block has an intermediate groove therein perpendicular to the plane of said planar member.

10. The solid rectangular building block defined in claim 5, in which a further remaining face of said block has intersecting grooves therein extending perpendicularly to one another.

* * * * *